US009383093B2

(12) United States Patent
Tilmont et al.

(10) Patent No.: US 9,383,093 B2
(45) Date of Patent: Jul. 5, 2016

(54) HIGH EFFICIENCY DIRECT CONTACT HEAT EXCHANGER

(71) Applicant: Orbital ATK, Inc., Dulles, VA (US)

(72) Inventors: Daniel Tilmont, Rocky Point, NY (US); Joseph A. Alifano, Commack, NY (US)

(73) Assignee: Orbital ATK, Inc., Plymouth, MN (US)

( * ) Notice: Subject to any disclaimer, the term of this patent is extended or adjusted under 35 U.S.C. 154(b) by 417 days.

(21) Appl. No.: 13/793,891

(22) Filed: Mar. 11, 2013

(65) Prior Publication Data

US 2013/0340691 A1 Dec. 26, 2013

Related U.S. Application Data

(60) Provisional application No. 61/664,015, filed on Jun. 25, 2012.

(51) Int. Cl.

| | |
|---|---|
| ***F22B 1/18*** | (2006.01) |
| ***E21B 36/02*** | (2006.01) |
| ***E21B 43/243*** | (2006.01) |

(Continued)

(52) U.S. Cl.

CPC ..... *F22B 1/1853* (2013.01); *E21B 36/02* (2013.01); *E21B 43/122* (2013.01); *E21B 43/24* (2013.01); *E21B 43/243* (2013.01); *E21B 43/26* (2013.01); *E21B 43/263* (2013.01); *F22B 27/02* (2013.01); *F22B 27/12* (2013.01); *F23D 14/02* (2013.01); *F23D 14/70* (2013.01); *F23Q 7/00* (2013.01);

(Continued)

(58) Field of Classification Search

CPC ..... E21B 36/02; E21B 36/025; E21B 43/122; E21B 43/24; E21B 43/2408; F22B 1/1853

USPC ..... 122/31.1, 31.2, 44.1, 118, 404, 442, 122/367.1, 367.2, 367.3; 166/303; 165/60, 165/120; 126/404

See application file for complete search history.

(56) References Cited

U.S. PATENT DOCUMENTS

| | | | |
|---|---|---|---|
| 2,707,029 | A | 4/1955 | Van Hartesveldt |
| 2,803,305 | A | 8/1957 | Behning et al. |

(Continued)

FOREIGN PATENT DOCUMENTS

| | | |
|---|---|---|
| CA | 2638855 | 4/2009 |
| EP | 2 199 538 A2 | 6/2010 |

(Continued)

OTHER PUBLICATIONS

International Search Report for International Application No. PCT/US2013/047266, mailed Apr. 5, 2015, 4 pages.

(Continued)

*Primary Examiner* — Alissa Tompkins
*Assistant Examiner* — Benjamin W Johnson
(74) *Attorney, Agent, or Firm* — TraskBritt

(57) ABSTRACT

A direct contact heat exchanger assembly is provided. The direct contact heat exchanger assembly includes an evaporator jacket and an inner member. The inner member is received within the evaporator jacket. A sleeve passage is formed between the evaporator jacket and the inner member. The sleeve passage is configured and arranged to pass a flow of liquid. The inner member has an inner exhaust chamber that is configured to pass hot gas. The inner member further has a plurality of exhaust passages that allow some of the hot gas passing through the inner exhaust chamber to enter the flow of liquid in the sleeve passage.

22 Claims, 3 Drawing Sheets

(51) Int. Cl.

| | |
|---|---|
| ***E21B 43/263*** | (2006.01) |
| ***F23D 14/02*** | (2006.01) |
| ***F23D 14/70*** | (2006.01) |
| ***F23Q 7/00*** | (2006.01) |
| ***E21B 43/12*** | (2006.01) |
| ***E21B 43/24*** | (2006.01) |
| ***E21B 43/26*** | (2006.01) |
| ***F23R 3/34*** | (2006.01) |
| ***F22B 27/02*** | (2006.01) |
| ***F22B 27/12*** | (2006.01) |

(52) U.S. Cl.
CPC ..... *F23R 3/343* (2013.01); *Y10T 137/0329* (2015.04)

(56) References Cited

U.S. PATENT DOCUMENTS

| | | | | |
|---|---|---|---|---|
| 3,223,539 | A | 12/1965 | Hyde et al. | |
| 3,284,137 | A | 11/1966 | Wolber | |
| 3,456,721 | A * | 7/1969 | Smith | E21B 36/02 166/59 |
| 3,482,630 | A | 12/1969 | Earlougher, Jr. | |
| 3,522,995 | A | 8/1970 | Erickson | |
| 3,587,531 | A * | 6/1971 | Everett | 122/156 |
| 3,674,093 | A | 7/1972 | Reese | |
| 4,205,725 | A | 6/1980 | Howard et al. | |
| 4,237,973 | A | 12/1980 | Todd | |
| 4,243,098 | A | 1/1981 | Meeks et al. | |
| 4,326,581 | A * | 4/1982 | Rapier | 165/45 |
| 4,336,839 | A | 6/1982 | Wagner et al. | |
| 4,366,860 | A * | 1/1983 | Donaldson et al. | 166/59 |
| 4,377,205 | A | 3/1983 | Retallick | |
| 4,380,265 | A | 4/1983 | Mohaupt | |
| 4,380,267 | A | 4/1983 | Fox | |
| 4,385,661 | A | 5/1983 | Fox | |
| 4,390,062 | A | 6/1983 | Fox | |
| 4,397,356 | A | 8/1983 | Retallick | |
| 4,411,618 | A | 10/1983 | Donaldson et al. | |
| 4,421,163 | A | 12/1983 | Tuttle | |
| 4,431,069 | A | 2/1984 | Dickinson, III et al. | |
| 4,442,898 | A | 4/1984 | Wyatt | |
| 4,458,756 | A | 7/1984 | Clark | |
| 4,463,803 | A | 8/1984 | Wyatt | |
| 4,471,839 | A | 9/1984 | Snavely et al. | |
| 4,498,531 | A | 2/1985 | Vrolyk | |
| 4,522,263 | A | 6/1985 | Hopkins et al. | |
| 4,558,743 | A | 12/1985 | Ryan et al. | |
| 4,648,835 | A | 3/1987 | Eisenhawer et al. | |
| 4,682,471 | A | 7/1987 | Wagner | |
| 4,699,213 | A | 10/1987 | Fleming | |
| 4,718,489 | A | 1/1988 | Hallam et al. | |
| 4,783,585 | A | 11/1988 | Meshekow | |
| 4,805,698 | A | 2/1989 | Baugh et al. | |
| 4,834,174 | A | 5/1989 | Vandevier | |
| 4,861,263 | A * | 8/1989 | Schirmer | 431/158 |
| 4,895,206 | A | 1/1990 | Price | |
| 4,988,287 | A * | 1/1991 | Stegelman et al. | 431/284 |
| 5,052,482 | A | 10/1991 | Gondouin | |
| 5,211,230 | A | 5/1993 | Ostapovich et al. | |
| 5,339,897 | A | 8/1994 | Leaute | |
| 5,525,044 | A | 6/1996 | Chen | |
| 5,623,576 | A | 4/1997 | Deans | |
| 5,623,819 | A | 4/1997 | Bowker et al. | |
| 5,775,426 | A | 7/1998 | Snider et al. | |
| 6,491,096 | B1 * | 12/2002 | Masek | 166/275 |
| 6,959,760 | B1 | 11/2005 | Braithwaite et al. | |
| 7,493,952 | B2 | 2/2009 | Ayasse | |
| 7,497,253 | B2 | 3/2009 | Retallick et al. | |
| 7,628,204 | B2 | 12/2009 | Iqbal et al. | |
| 7,640,987 | B2 | 1/2010 | Kalman et al. | |
| 7,665,525 | B2 | 2/2010 | Pfefferle | |
| 7,712,528 | B2 | 5/2010 | Langdon et al. | |
| 7,770,646 | B2 | 8/2010 | Klassen et al. | |
| 7,784,533 | B1 | 8/2010 | Hill | |
| 7,946,342 | B1 | 5/2011 | Robertson | |
| 8,075,858 | B1 * | 12/2011 | Itse | B01D 53/79 110/203 |
| 8,091,625 | B2 | 1/2012 | Ware et al. | |
| 2007/0284107 | A1 | 12/2007 | Crichlow | |
| 2008/0017381 | A1 | 1/2008 | Baiton | |
| 2008/0087427 | A1 | 4/2008 | Kaminsky et al. | |
| 2009/0260811 | A1 | 10/2009 | Cui et al. | |
| 2009/0288827 | A1 | 11/2009 | Coskuner | |
| 2010/0181069 | A1 | 7/2010 | Schneider et al. | |
| 2010/0224370 | A1 | 9/2010 | Donnelly et al. | |
| 2011/0000666 | A1 | 1/2011 | Couto | |
| 2011/0120710 | A1 | 5/2011 | Dong et al. | |
| 2011/0127036 | A1 | 6/2011 | Tilmont et al. | |
| 2011/0227349 | A1 | 9/2011 | Huber et al. | |
| 2011/0297374 | A1 | 12/2011 | Kuhlman et al. | |
| 2013/0161007 | A1 | 6/2013 | Wolfe et al. | |
| 2013/0341015 | A1 | 12/2013 | Tilmont et al. | |
| 2013/0344448 | A1 | 12/2013 | Tilmont et al. | |

FOREIGN PATENT DOCUMENTS

| | | | |
|---|---|---|---|
| GB | 2 287 312 | A | 9/1995 |
| WO | WO 2006/063200 | A2 | 6/2006 |
| WO | WO 2011/103190 | A1 | 8/2011 |
| WO | 2014004352 | A2 | 1/2014 |

OTHER PUBLICATIONS

International Written Opinion for International Application No. PCT/US2013/047266, mailed Apr. 5, 2015, 6 pages.

Blogspot.com, Centrifugal Pump/Deep Well Pump/Sump Pump [online], Aug. 1, 2008, [retrieved on Nov. 26, 2013]. Retrieved from the internet <http://pump-detail.blogspot.com/2008_08_01_archive.html>, 14 pages.

* cited by examiner

HIGH EFFICIENCY DIRECT CONTACT HEAT EXCHANGER

CROSS-REFERENCE TO RELATED APPLICATION

This application claims priority to U.S. Provisional Patent Application Ser. No. 61/664,015, titled APPARATUSES AND METHODS IMPLEMENTING A DOWNHOLE COMBUSTOR, filed on Jun. 25, 2012, which is incorporated in its entirety herein by reference.

BACKGROUND

Thermal stimulation equipment used for generating steam or a gas from a liquid such as downhole steam generator systems, high pressure chemical processing systems, purification and cleaning process systems, pumping equipment systems, etc., are subject to failure due to creep fatigue, corrosion and erosion. A primary source of corrosion is from dissolved solids, chlorine, and salts that are released from boiling water. Another source of corrosion is from fuel (e.g., sulfur). A third source of corrosion is from an oxidizing agent (i.e., dissolved oxygen that may create rust). A primary source of erosion is from high velocity water and gas, and a secondary source of erosion is from particulates from supply lines.

The effectiveness of downhole steam generators is directly related to the ability of the downhole steam generators to provide high quality steam. The length required for heat exchange, is an essential issue related to the length of the tool, and, as a consequence, affects the cost of the steam generator and complexity of installation. Providing high quality steam as close as possible to the formation being stimulated is an issue driving efficiency of the downhole steam generator system.

For the reasons stated above and for other reasons stated below, which will become apparent to those skilled in the art upon reading and understanding the present specification, there is a need in the art for an evaporator configuration that provides steam that is effective, efficient and robust to limit downhole stimulation equipment from fatigue, corrosion and erosion.

BRIEF SUMMARY

The above-mentioned problems of current systems are addressed by embodiments of the present invention and will be understood by reading and studying the following specification. The following summary is made by way of example and not by way of limitation. It is merely provided to aid the reader in understanding some of the aspects of the invention.

In one embodiment, a direct contact heat exchanger assembly is provided. The direct contact heat exchanger includes an evaporator jacket and an inner member. The inner member is received within the evaporator jacket. A sleeve passage is formed between the evaporator jacket and the inner member. The sleeve passage is configured and arranged to pass a flow of liquid. The inner member has an inner exhaust chamber that is operably to pass hot gas. The inner member further has a plurality of exhaust passages that allows some of the hot gas passing through the inner exhaust chamber to enter the flow of liquid in the sleeve passage.

In another embodiment, another direct contact heat exchanger assembly is provided. The direct contact heat exchanger assembly, includes an elongated cylindrical evaporator jacket, a cylindrical inner member, and a plurality of raised fins. The cylindrical inner member is received within the evaporator jacket. The inner member has an inner surface that defines an inner exhaust chamber. The inner member is configured and arranged to pass hot gas through the inner exhaust chamber. An outer surface of the inner member and an inner surface of the evaporator jacket are spaced to form an annular shaped sleeve passage that extends around an outer surface of the inner member. The sleeve passage is configured and arranged to pass a flow of liquid. The inner member has a plurality of exhaust passages that extends from the inner exhaust chamber into the sleeve passage. The exhaust passages allow at least some of the hot gas passing in the inner exhaust chamber to mix with the liquid passing in the sleeve passage to create a gas mix in the sleeve passage. Each of the plurality of raised fins extends out from the outer surface of the inner member within the sleeve passage to cause the flow of liquid to take a swirling path in the sleeve passage.

In another embodiment, a method of forming a direct contact heat exchanger is provided. The method comprises passing a body of liquid through a passage and injecting hot gas into the moving body of liquid in the passage.

BRIEF DESCRIPTION OF THE DRAWINGS

The present invention can be more easily understood and further advantages and uses thereof will be more readily apparent, when considered in view of the detailed description and the following figures in which.

In accordance with common practice, the various described features are not drawn to scale but are drawn to emphasize specific features relevant to the present invention. Reference characters denote like elements throughout the figures and the text.

DETAILED DESCRIPTION

In the following detailed description, reference is made to the accompanying drawings, which form a part hereof and in which is shown by way of illustration, specific embodiments in which the inventions may be practiced. These embodiments are described in sufficient detail to enable those skilled in the art to practice the invention, and it is to be understood that other embodiments may be utilized and that changes may be made without departing from the spirit and scope of the present invention. The following detailed description is, therefore, not to be taken in a limiting sense, and the scope of the present invention is defined only by the claims and equivalents thereof.

Figure 1:
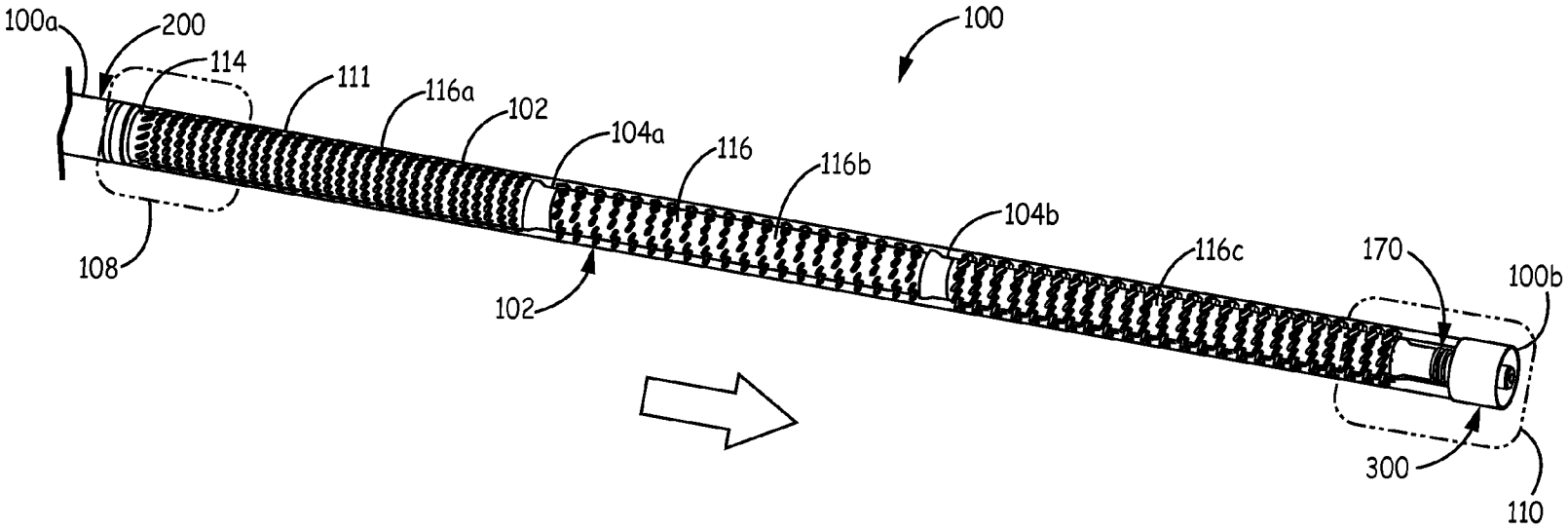
FIG. 1 is a side perspective view of a direct contact heat exchanger assembly of one embodiment of the present invention.

Embodiments of the present invention provide a direct contact heat exchanger assembly that works with a downhole combustor. The direct contact heat exchanger assembly utilizes swirling water to provide a robust direct contact heat exchanger assembly that generates steam or other high vapor fraction fluid. The steam could then be injected into a reservoir for production of hydrocarbons or utilized to provide energy into a downstream mechanism. Referring to FIG. 1, a direct contact heat exchanger assembly 100 of one embodiment is illustrated. The direct contact heat exchanger assembly 100 includes an outer evaporator jacket 102 that encases the direct contact heat exchanger assembly 100. The direct contact heat exchanger assembly 100 is positioned between a combustor 200 positioned at an intake end 100*a* of the direct contact heat exchanger assembly 100 and an optional radial support portion 300 that is positioned at an exit end 100*b* of the direct contact heat exchanger assembly 100. The combustor 200, also known as a hot gas generator 200, in an embodiment, provides a fuel rich combustion. An example of a combustor 200 is illustrated in commonly assigned patent application, U.S. patent application Ser. No. 13/745,196, filed on Jan. 18, 2013, now U.S. Pat. No. 9,228,738, issued Jan. 5, 2016, titled "DOWNHOLE COMBUSTOR," which is herein incorporated in its entirety by reference and a combustor described in U.S. Provisional Patent Application Ser. No. 61/664,015, titled "APPARATUSES AND METHODS IMPLEMENTING A DOWNHOLE COMBUSTOR," filed on Jun. 25, 2012. The combustor 200, in an embodiment, includes an initial ignition chamber (secondary chamber) and a main combustion chamber. The combustor 200 takes separate air and fuel flows and mixes the air/fuel flows into a single premix air/fuel stream. The momentum from a premix injection stirs the ignition chamber at extremely low velocities, relative to the total flow of air and fuel through the combustor 200. Diffusion and mixing caused by the stirring effect changes an initial mixture of the air/oxidant (air/fuel) to a premixed combustible flow. The premixed combustible flow is then ignited by one or more glow plugs. Insulated walls limit heat loss therein helping to raise the temperature of the premixed gases. Once the gases reach an auto-ignition temperature, an ignition occurs. The ignition acts as a pulse, sending a deflagration wave into the main combustion chamber of the combustor 200 therein igniting a main flow field. Once this is accomplished, the one or more glow plugs are turned off and the initial ignition chamber no longer sustains combustion. One benefit to this system is that only a relatively small amount of power (around 300 Watts) is needed to heat up the glow plugs at a steady state. The combustion product of the combustor 200 is used by the direct contact heat exchanger assembly 100 to heat water to generate steam, as described below.

In FIG. 1, the evaporator jacket 102 of the direct contact heat exchanger assembly 100 is shown as transparent so inner assemblies are illustrated. The evaporator jacket 102 provides protection for the inner assemblies. The inner assemblies of the direct contact heat exchanger assembly 100 include a cylindrical inner member 111, which includes a turning vane 114 and a stator 116. The turning vane 114 and the stator 116 are positioned between the combustor 200 and a radial support 300. The stator 116, in this embodiment, includes a first stator portion 116*a*, a second stator portion 116*b*, and a third stator portion 116*c*. The first stator portion 116*a* is cylindrical in shape and has a first diameter. The second stator portion 116*b* is also cylindrical in shape and has a second diameter. The third stator portion 116*c* is also cylindrical in shape and has a third diameter. The third diameter of the third stator portion 116*c* is less than the second diameter of the second stator portion 116*b* and the second diameter of the second stator portion 116*b* is less than the first diameter of the first stator portion 116*a*. The stator portions 116*a*, 116*b*, and 116*c* are separated from each other by reducer sections 104*a* and 104*b* that provide a reduction passage between respective first, second, and third stator portions 116*a*, 116*b*, and 116*c*. Reduction of the diameter of the stator portions 116*a*, 116*b*, and 116*c*, in this embodiment, corresponds to an increase in distance from the combustor 200, which reduces pressure required to drive the flow through the direct contact heat exchanger assembly 100, as discussed further below.

Figure 2:
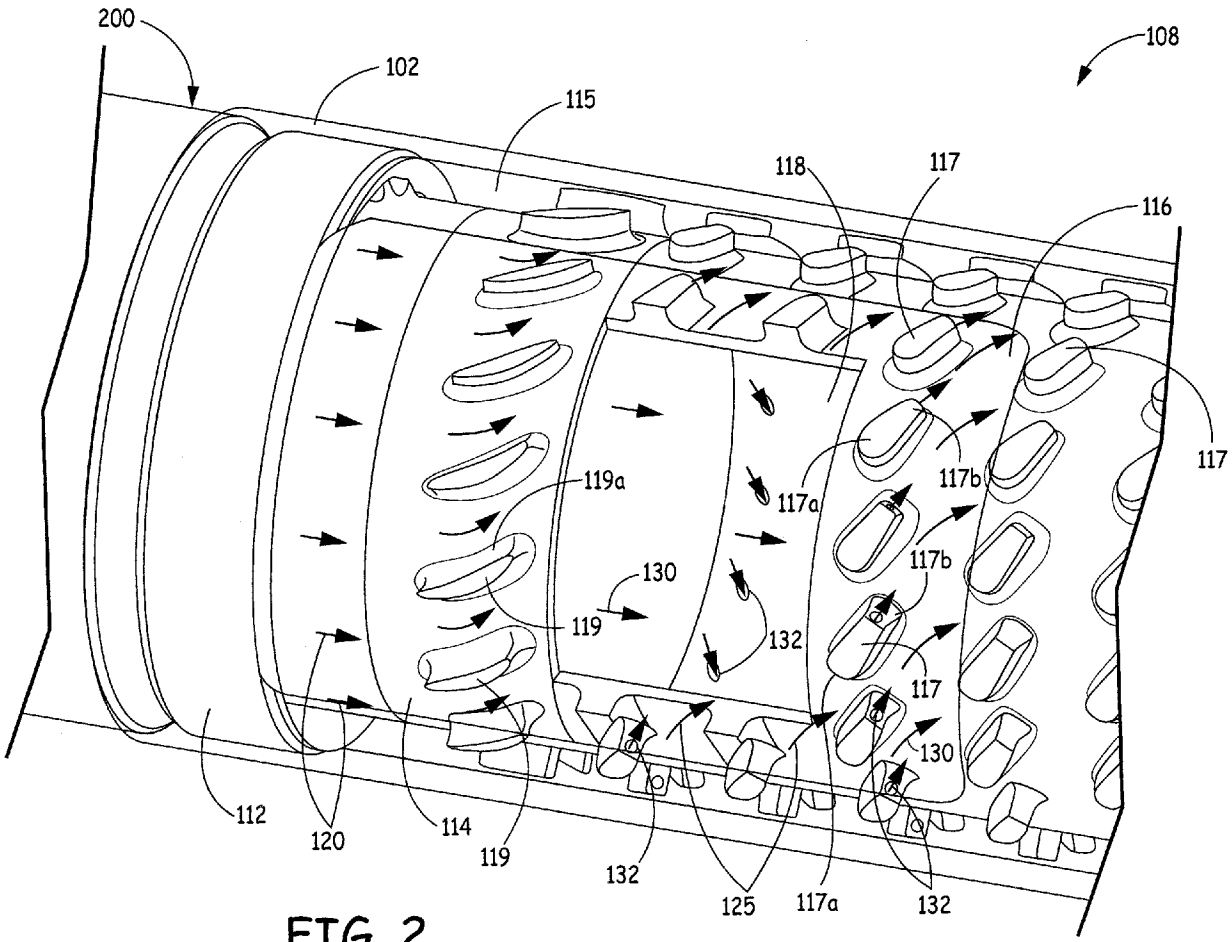
FIG. 2 is a close-up side view of a portion of the direct contact heat exchanger assembly of FIG. 1.
Figure 3:
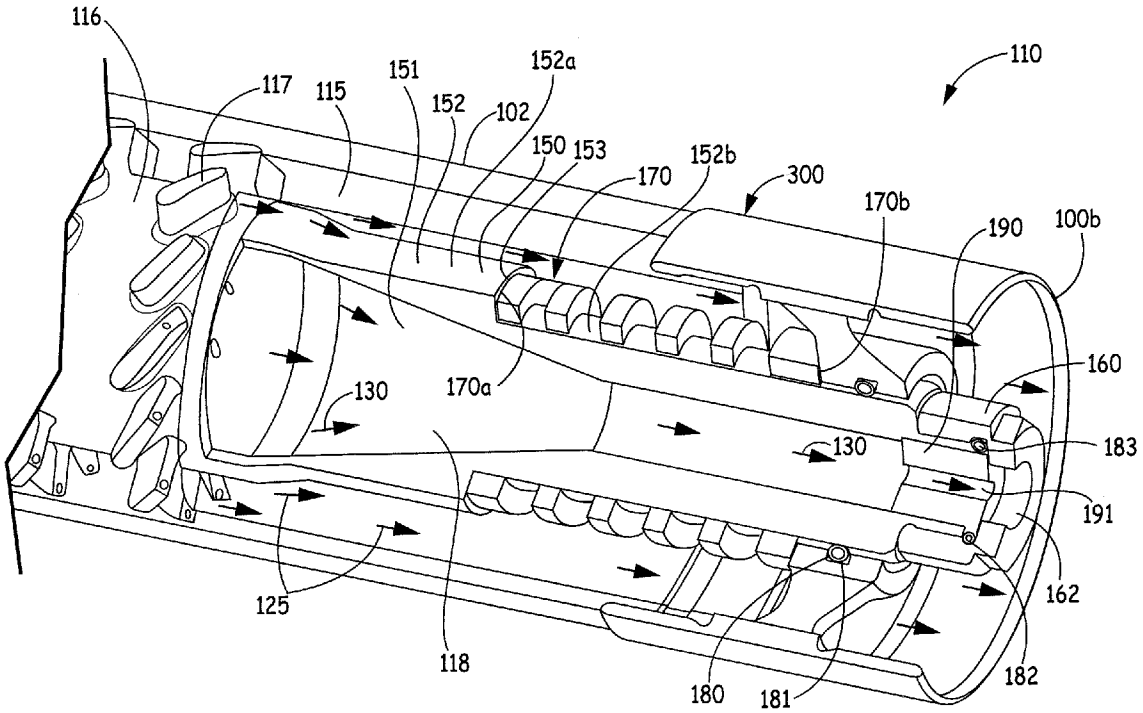
FIG. 3 is a close-up view of another portion of the direct contact heat exchanger assembly of FIG. 1.

Close-up views 108 and 110 of FIGS. 2 and 3, respectively, further illustrate portions of the direct contact heat exchanger assembly 100 of FIG. 1. In particular, close-up view 108 of FIG. 2, illustrates a portion of the direct contact heat exchanger assembly 100 leading from the combustor 200. As illustrated in the close-up view 108, the direct contact heat exchanger assembly 100 includes the outer evaporator jacket 102 that protects the system. The assembly 100 includes an inner exhaust chamber 118 in which the combustor 200 exhausts combustion product 130. Defining the inner chamber 118 includes a cylindrical turning vane 114 portion and the cylindrical stator 116. Also illustrated, is an outer sleeve passage 115 that is annular in shape and is formed between the evaporator jacket 102 and the turning vane 114 and stator portions 116*a*, 116*b*, and 116*c*.

Further leading from the combustor 200 is a collar 112. Water 120 pumped into the direct contact heat exchanger assembly 100 passes out under the collar 112 and into the outer sleeve passage 115. As discussed above, the turning vane 114 is cylindrical in shape. The turning vane 114 has a plurality of elongated outer extending raised directional turning fins 119. The raised directional turning fins 119 are shaped and positioned to direct the flow of water 120 passing under the collar 112. In particular, the raised directional turning fins 119 of the turning vane 114 direct the flow of water 120 into a helical path in the sleeve passage 115. In one embodiment, the raised directional turning fins 119 include a curved surface 119*a* that extends along its length to direct a helical flow of water 120 in the sleeve passage 115. The helical flow path (swirl flow) in the sleeve passage 115 is maintained with the stator 116, as described below. The swirl flow causes a centrifugal force such that the water 120 acts as a single body forced against the outer wall, i.e., no individual droplets of water are able to form. The swirl flow further prevents the water 120 from pooling in areas due to gravitational effects, which can cause an uneven thermal distribution throughout the direct contact heat exchanger assembly 100 potentially reducing a useful life of the direct contact heat exchanger assembly 100. The swirl angle is set such that the centrifugal force generated is able to overcome gravity based on the total throughput in direct contact heat exchanger assembly 100.

The stator 116 extends from the turning vane 114 and is also cylindrical in shape, such as reducer sections 104*a* and 104*b*, as discussed above in FIG. 1. The stator portions 116*a*, 116*b*, and 116*c* each include a plurality of elongated outer extending directional maintaining fins 117 that is designed to preserve the swirl flow of water 120 and vapor started by the raised directional turning fins 119 of the turning vane 114 in the sleeve passage 115. At least one of the stator portions 116*a*, 116*b*, and 116*c* includes a plurality of exhaust passages 132 that extends from the inner chamber 118 to the sleeve passage 115. The exhaust passages 132 provide an effluent path for the combustion product 130 from the inner chamber 118 to the sleeve passage 115. The exhaust passages 132 are angled to enhance and maintain the helical flow path in the sleeve passage 115. Some of the combustion product 130 (exhaust from the combustor 200) passes through the exhaust passages 132 and heats up the water 120 flowing in the sleeve passage 115. The water 120, in response to the hot combustion product 130, turns into a steam mix 125 in the sleeve passage 115 that continues in the swirl pattern. As stated above, the exhaust passages 132 are angled to aid and maintain the helical flow path of the water 120/steam mix 125. In one embodiment, at least some of the exhaust passages 132 pass out an end of a respective directional maintaining fin 117 of the stator 116. As illustrated in FIG. 2, a directional maintaining fin 117 has a length defined between a first end 117*a* and an opposed, second end 117*b*. The first end 117*a*, in this embodiment, is rounded to minimize friction encountered by the steam mix 125 as the steam mix 125 flows in the spiral pattern in the sleeve passage 115. Moreover, in this embodiment, the first end 117*a* of the directional maintaining fin 117 is wider than the second end 117*b* of the directional maintaining fin 117 to enhance flow. An exhaust passage 132, in an embodiment, is positioned to extend out of the second end 117*b* of the directional maintaining fin 117.

Referring to FIG. 3, a close-up view of section 110 of the direct contact heat exchanger assembly 100 of FIG. 1 is illustrated. The exit end 100*b* of the direct contact heat exchanger assembly 100 illustrates where the combustion product 130 and steam mix 125 exit the direct contact heat exchanger assembly 100. As illustrated, an end portion 150 extends from the stator 116. The end portion 150 is generally cylindrical in shape to maintain the inner chamber 118 and the sleeve passage 115. The end portion 150 includes an inner surface 151 that is as wide as an inner surface of the stator 116, but narrows as it extends to an orifice end cap 160. Hence, the inner chamber 118 narrows as it reaches the end cap 160. The end cap 160 includes a central opening 162 in which the combustion product 130 leaves the direct contact heat exchanger assembly 100. Within the orifice end cap 160, is housed an orifice member 190 that includes an orifice passage 191 that leads from the inner chamber 118 to the central opening 162 of the end cap 160. The orifice member 190 creates a back pressure. The back pressure is used to increase the flow rate to upstream portions of direct contact heat exchanger assembly 100 at low flow rates. At high flow rates, the orifice member 190 relieves back pressure so that the structural integrity of the direct contact heat exchanger assembly 100 meets life requirements for operation of the direct contact heat exchanger assembly 100. The end portion 150 further includes an outer surface that includes a first portion 152*a* and a second portion 152*b*. The first portion 152*a* of an outer surface 152 of the end portion 150 is positioned next to the stator portion 116. The second portion 152*b* has a smaller diameter than the first portion 152*a* of the outer surface 152 of the end portion 150 such that a shoulder 153 is formed between the first portion 152*a* and the second portion 152*b* of the outer surface 152 of the end portion 150. A thermal growth spring 170 is positioned over the second portion 152*b* of the outer surface 152 of the end portion 150. The thermal growth spring 170 has a first end 170*a* that engages the shoulder 153 in the outer surface 152 of the end portion 150. A second end 170*b* of the thermal growth spring 170 engages a portion of the radial support 300. The thermal growth spring 170 allows the stator 116 to transmit structural loads of transportation and handling, while providing the flexibility to relieve thermal growth once downhole and in operation, which reduces the propensity for creep fatigue failures. Also illustrated in the embodiment of FIG. 3, is a first centering spring 180. The first centering spring 180 is received in an inner groove 181 of the radial support 300. The first centering spring 180 further engages the second portion 152*b* of the outer surface 152 of the end portion 150 to help position the end portion 150 in relation to the radial support 300 in order to effectively transfer loads from end portion 150 to radial support 300, while allowing relative motion along the longitudinal axis. Also illustrated in FIG. 3 is a second centering spring 182. The second centering spring 182 is received in a groove 183 in the end cap 160. The second centering spring 182 is engaged with an outer surface of the orifice portion 190. The second centering spring 182 helps position the orifice portion 190 in relation to the end cap 160 and relieve thermal growth of the orifice portion 190. As illustrated in FIG. 3, the steam mixture 125 exits the direct contact heat exchanger assembly 100 via the sleeve passage 115, which extends to an exit end 100*b* of the direct contact heat exchanger assembly 100.

Although specific embodiments have been illustrated and described herein, it will be appreciated by those of ordinary skill in the art that any arrangement, which is calculated to achieve the same purpose, may be substituted for the specific embodiments shown. This application is intended to cover any adaptations or variations of the present invention. Therefore, it is manifestly intended that this invention be limited only by the claims and the equivalents thereof.

The invention claimed is:

1. A direct contact heat exchanger assembly comprising:

an evaporator jacket; and an inner member received within the evaporator jacket, a sleeve passage defined between the evaporator jacket and the inner member, the sleeve passage configured and arranged to pass a flow of water therethrough, the inner member defining an inner exhaust chamber configured to pass hot gas from a combustor therethrough, the inner member further having a plurality of exhaust passages extending from the inner exhaust chamber through a sidewall of the inner member to the sleeve passage to enable at least a portion of the hot gas passing through the inner exhaust chamber to enter the flow of water in the sleeve passage; wherein the evaporator jacket is elongated and generally cylindrical in shape, and the inner member comprises;

a generally cylindrical turning vane received within the evaporator jacket, the turning vane having an inner surface defining at least part of the inner exhaust chamber, the turning vane configured to pass hot fluid from the combustor through the inner exhaust chamber, an outer surface of the turning vane and an inner surface of the evaporator jacket are spaced to form, at least in part, the sleeve passage, the sleeve passage exhibiting an annular shape and extending around the outer surface of the turning vane, the turning vane having a plurality of elongated raised directional turning fins extending out from the outer surface of the turning vane within the sleeve passage, the turning fins positioned to direct a flow of water in the sleeve passage into a swirling path around the turning vane; and a generally cylindrical stator received within the evaporator jacket, the stator longitudinally coupled to the turning vane, the stator having an inner surface configured and arranged to form at least another part of the inner exhaust chamber, the stator having an outer surface, the outer surface of the stator and the inner surface of the evaporator jacket spaced to form at least another part of the sleeve passage, the stator having a plurality of elongated raised directional maintaining fins extending out from the outer surface of the stator within the sleeve passage to maintain the swirling path of the flow of water directed by the turning fins of the turning vane, the plurality of exhaust passages extending from an interior of the stator between the inner exhaust chamber and the sleeve passage.

2. The direct contact heat exchanger assembly of claim 1, wherein each turning fin includes a curved side surface configured and oriented to direct the flow of fluid in the swirling path in the sleeve passage.

3. The direct contact heat exchanger assembly of claim 1, wherein at least one of the directional maintaining fins further includes a length defined between a first leading end and a second trailing end, the first leading end being rounded, the second trailing end of the at least one directional maintaining fin having an opening from one of the exhaust passages to the sleeve passage.

4. The direct contact heat exchanger assembly of claim 1, wherein at least one exhaust passage of the plurality of exhaust passages extends through a portion of an associated directional maintaining fin on the stator.

5. The direct contact heat exchanger assembly of claim 1, further comprising:

a cylindrical end portion having a first end coupled longitudinally to the stator, the cylindrical end portion received within the evaporator jacket, the cylindrical end portion having an inner surface forming, another part of the inner exhaust chamber, the cylindrical end portion further having an outer surface, the outer surface of the cylindrical end portion spaced a distance from the evaporator jacket to form, another part of the sleeve passage, the cylindrical end portion further having a second end, the inner surface having a smaller diameter at the second end of the cylindrical end portion than a diameter at the first end of the cylindrical end portion.

6. The direct contact heat exchanger assembly of claim 5, wherein the outer surface of the cylindrical end portion comprises a shoulder, and the direct contact heat exchanger assembly further comprises:

a thermal growth spring having a first end and a second end, the first end of the thermal growth spring contacting the shoulder of the cylindrical end portion; and a radial support coupled to the evaporator jacket proximate an end thereof, the second end of the thermal growth spring extending longitudinally from the shoulder of the outer surface of the cylindrical end portion to contact a portion of the radial support.

7. The direct contact heat exchanger assembly of claim 5, further comprising:

an orifice end cap coupled to the second end of the end portion, the orifice end cap having a central opening configured to enable combustion products to pass out of the inner exhaust chamber; and an orifice member received within the end cap, the orifice member having an orifice passage leading from the inner exhaust chamber to the central opening of the end cap.

8. The direct contact heat exchanger assembly of claim 1, wherein the stator further comprises:

at least a first stator portion and a longitudinally adjacent second stator portion, the first stator portion having a first diameter, the second stator portion having a second, smaller diameter; and at least one reducer coupling the first stator portion having the first diameter to the second stator portion having the second, smaller diameter.

9. A direct contact heat exchanger assembly, comprising:

an elongated cylindrical evaporator jacket; a cylindrical inner member received within the evaporator jacket, the inner member having an inner surface defining an inner exhaust chamber, the inner member configured and arranged to pass hot gas through the inner exhaust chamber, an outer surface of the inner member and an inner surface of the evaporator jacket spaced to form an annular shaped sleeve passage extending around the outer surface of the inner member, the sleeve passage configured and arranged to pass a flow of water therethrough, the inner member having a plurality of exhaust passages extending from the inner exhaust chamber through a sidewall of the inner member to the sleeve passage, the plurality of exhaust passages allowing some of the hot gas passing in the inner exhaust chamber to mix with the flow of water passing in the sleeve passage to create a gas mix in the sleeve passage; and a plurality of raised fins extending out from the outer surface of the inner member within the sleeve passage configured and oriented to impart or maintain a swirling path to the flow of water in the sleeve passage; wherein at least some of the plurality of exhaust passages each pass through an associated fin of the plurality of raised fins to the sleeve passage.

10. The direct contact heat exchanger assembly of claim 9, wherein the plurality of raised fins further comprises:

a plurality of elongated raised directional turning fins extending out from the outer surface of the inner member within the sleeve passage, the turning fins positioned to direct the flow of water in the sleeve passage into the swirling path around the inner member; and a plurality of elongated raised directional maintaining fins longitudinally spaced from the plurality of elongated raised directional turning fins and extending out from the outer surface of the inner member within the sleeve passage to maintain the swirling path started by the directional turning fins.

11. The direct contact heat exchanger assembly of claim 10, wherein each turning fin includes a curved side surface configured and arranged to direct the swirling path into the flow of water in the sleeve passage.

12. The direct contact heat exchanger assembly of claim 10, wherein at least one of the directional maintaining fins further includes a length defined between a first leading end and a second trailing end, the second trailing end of the directional maintaining fin having an opening extending from one of the exhaust passages to the sleeve passage.

13. The direct contact heat exchanger assembly of claim 9, further comprising:

a cylindrical end portion having a first end coupled to the stator, the cylindrical end portion received within the evaporator jacket, the cylindrical end portion having an inner surface that forms part of the inner exhaust chamber, the cylindrical end portion further having an outer surface, the outer surface of the cylindrical end portion spaced a distance from the evaporator jacket to form part of the sleeve passage, the cylindrical end portion further having a second end, the inner surface having a smaller diameter at the second end of the cylindrical end portion than a diameter at the first end of the end portion;

a thermal growth spring having a first end and a second end, the first end of the thermal growth spring contacting the shoulder of the end portion; and a radial support coupled to the evaporator jacket proximate an end thereof, the second end of the thermal growth spring extending longitudinally from the shoulder of the cylindrical end portion and contacting a portion of the radial support.

14. The direct contact heat exchanger assembly of claim 13, further comprising:

an orifice end cap coupled to the second end, the orifice end cap having a central opening enabling combustion products to pass out of the inner exhaust chamber; and an orifice member received within the end cap, the orifice member having an orifice passage leading from the inner exhaust chamber to the central opening of the end cap.

15. The direct contact heat exchanger assembly of claim 9, wherein the inner member further comprises:

a generally cylindrical turning vane, a plurality of elongated raised directional turning fins extending outward from an outer surface of the turning vane within the sleeve passage to impart the swirling path to the flow of water within the sleeve passage; and at least one generally cylindrical stator coupled longitudinally to the turning vane, a plurality of elongated raised directional maintaining fins extending outward from an outer surface of the at least one stator within the sleeve passage to maintain the swirling path imparted to the flow of water within the sleeve passage by the turning fins of the turning vane.

16. The direct contact heat exchanger assembly of claim 15, wherein the at least one stator further comprises:

at least a first stator portion and a second, longitudinally adjacent stator portion, the first stator portion having a first diameter, the second stator portion having a second, smaller diameter; and at least one reducer coupling the first stator portion having the first diameter to the second stator portion having the second, smaller diameter.

17. A method of operating the direct contact heat exchanger of claim 1, the method comprising:

passing hot gas through the inner exhaust chamber;

passing a flow of water through the sleeve passage; and injecting hot gas into the flow of water in the sleeve passage through the plurality of exhaust passages extending from the inner exhaust chamber to the sleeve passage.

18. The method of claim 17, further comprising:

causing the flow of water through the sleeve passage to exhibit a swirling path.

19. The method of claim 17, further comprising:

swirling the flow of water in the sleeve passage around the inner member; and injecting a portion of the hot gas passing through the inner exhaust chamber into the flow of water through the plurality of exhaust passages extending from the inner exhaust chamber to the sleeve passage.

20. The method of claim 19, wherein swirling the flow of water around the inner member in the sleeve passage further comprises:

engaging the flow of water with elongated raised directional turning fins positioned within the sleeve passage.

21. The method of claim 19, further comprising:

creating back pressure of hot gas passing through the inner exhaust chamber.

22. The method of claim 19, further comprising:

thermally extending the length of the sleeve passage responsive to heat of the hot gas passing through the inner exhaust chamber.

* * * * *